US010319289B2

(12) United States Patent
Chang

(10) Patent No.: US 10,319,289 B2
(45) Date of Patent: Jun. 11, 2019

(54) METHOD FOR GENERATING DIMMING SIGNAL OF LIGHT EMITTING DIODE DISPLAY DEVICE

(71) Applicant: ANPEC ELECTRONICS CORPORATION, Hsinchu (TW)

(72) Inventor: Che-Chang Chang, Hsinchu County (TW)

(73) Assignee: ANPEC ELECTRONICS CORPORATION, Hsinchu (TW)

( * ) Notice: Subject to any disclaimer, the term of this patent is extended or adjusted under 35 U.S.C. 154(b) by 150 days.

(21) Appl. No.: 15/602,154

(22) Filed: May 23, 2017

(65) Prior Publication Data

US 2018/0190183 A1 Jul. 5, 2018

(30) Foreign Application Priority Data

Jan. 4, 2017 (TW) ..... 106100167 A

(51) Int. Cl.
*G09G 3/20* (2006.01)
*G09G 3/32* (2016.01)
*G09G 5/10* (2006.01)

(52) U.S. Cl.
CPC ..... *G09G 3/32* (2013.01); *G09G 3/2025* (2013.01); *G09G 5/10* (2013.01); *G09G 2300/06* (2013.01); *G09G 2310/08* (2013.01); *G09G 2320/0247* (2013.01); *G09G 2320/064* (2013.01)

(58) Field of Classification Search
None
See application file for complete search history.

(56) References Cited

U.S. PATENT DOCUMENTS

2009/0273558 A1* 11/2009 Lee ..... G09G 3/3426 345/102
2012/0075360 A1* 3/2012 Messmer ..... G09G 3/3406 345/690

* cited by examiner

*Primary Examiner* — Gustavo Polo
(74) *Attorney, Agent, or Firm* — Li & Cai Intellectual Property (USA) Office

(57) ABSTRACT

A dimming signal arranging method used for a light emitting diode display device is provided in the present disclosure. The dimming signal arranging method used for a light emitting diode display device includes the steps: determining whether a total number of dimming unit signals of a dimming signal is greater than a number of frames of a working interval; averagely arranging a first group of the dimming unit signals in at least one frame of the frame groups that is not a predetermined frame of each frame group; arranging a second group of the dimming unit group in at least one predetermined frame of the frame groups; and providing a dimming signal.

8 Claims, 7 Drawing Sheets

METHOD FOR GENERATING DIMMING SIGNAL OF LIGHT EMITTING DIODE DISPLAY DEVICE

BACKGROUND

1. Technical Field

The present disclosure relates to a light emitting diode display device, and in particular, to a light emitting diode display device capable of minimizing the flicker phenomenon.

2. Description of Related Art

In recent years, the micro LED technology has been developed. The LED display device has become the mainstream of large-scale outdoor display, but the dimming method of the LED display device is different from that of the LCD display device. The dimming method for LED display devices is aiming at extending the turn-on time of the LED to adjust the brightness.

Reference is made to FIG. 1A, FIG. 1B and FIG. 2. In general, the LED display device uses a 60 Hz scanning frequency to refresh the image. Therefore, each working interval WD is 1/60 second. As shown in FIG. 2, each working interval includes 16 frames. A number of the dimming unit signals ds denote the level of brightness, and one dimming unit signal ds stands for one level of brightness. When nine dimming unit signals are arranged in one working interval WD, the LED of the LED display device has nine levels of brightness in the working interval WD. In FIG. 1, the dimming unit signals are sequentially arranged in the frames of the working interval WD. When the number of the dimming unit signal is 1, the one dimming unit signal is arranged in the first frame, and when the number of the dimming unit signal is 2, the two dimming unit signals are sequentially arranged in the first frame and the second frame. However, the flicker phenomenon is observed when the LED display device is at a low level brightness.

Therefore, providing a light emitting diode display device capable of minimizing the flicker phenomenon at the low brightness has become an important issue in the art.

SUMMARY

In order to achieve the above purposes, a light emitting diode display device is provided in the present disclosure. The light emitting diode display device includes a light emitting diode matrix module, a control module, a first driving module electrically connected to the control module and the light emitting diode matrix module, and a second driving module electrically connected to the control module and the light emitting diode matrix module. The control module provides a first driving signal to drive the light emitting diode module through the first driving module and provides a second driving signal to drive the light emitting diode module through the second driving module. The control module adjusts brightness of the light emitting diode matrix module. The second driving signal includes a predetermined number of dimming unit signals. The second driving signal includes a plurality of working intervals, and each working interval has a first time interval. Each working interval of the second driving signal includes a plurality of frame groups, each frame group includes a plurality of frames, each frame group has a second time interval, and each frame has a third time interval. When a number of the dimming unit signals is greater than 2, the time interval between the two adjacent dimming unit signals that are arranged in different frame groups is less than or equal to the second time interval and greater than the third time interval.

In order to achieve the above purposes, a dimming signal arranging method used for a light emitting diode display device is provided in the present disclosure. The dimming signal arranging method used for a light emitting diode display device includes the steps: determining whether a total number of dimming unit signals of a dimming signal is greater than a number of frames of a working interval; averagely arranging a first group of the dimming unit signals in at least one frame of the frame groups that is not a predetermined frame of each frame group; arranging a second group of the dimming unit group in at least one predetermined frame of the frame groups; and providing a dimming signal.

According to the above, a plurality of frames of one working interval of the dimming signal are grouped into a plurality of frame groups, and the dimming unit signals for adjusting the brightness are averagely arranged in the frames as many as possible. Therefore, the brightness of the light emitting diode display device becomes more uniform, and the flicker phenomenon can be minimized at the low level brightness.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the present disclosure.

DESCRIPTION OF THE EXEMPLARY EMBODIMENTS

Figure 1A:
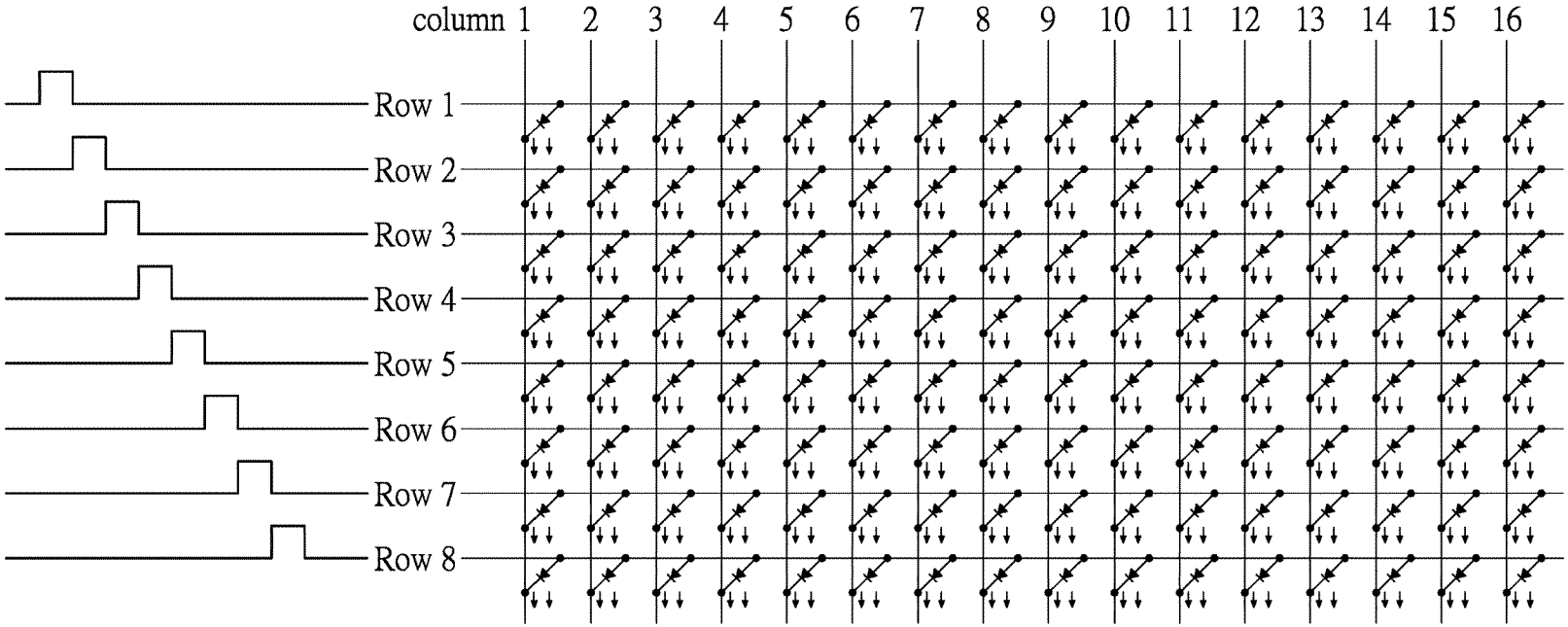
FIG. 1A is a schematic diagram of a dimming signal of a light emitting diode display device.
Figure 1B:
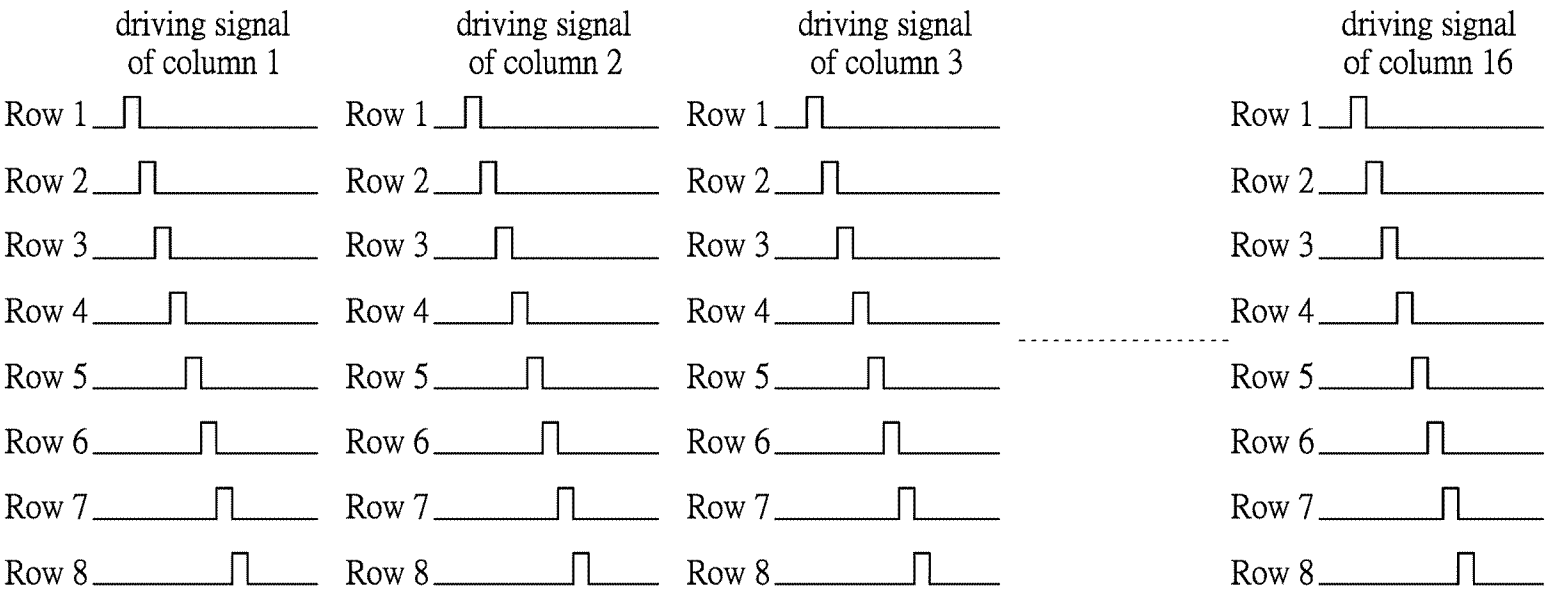
FIG. 1B is a schematic diagram of a driving signal of a light emitting diode display device.
Figure 2:
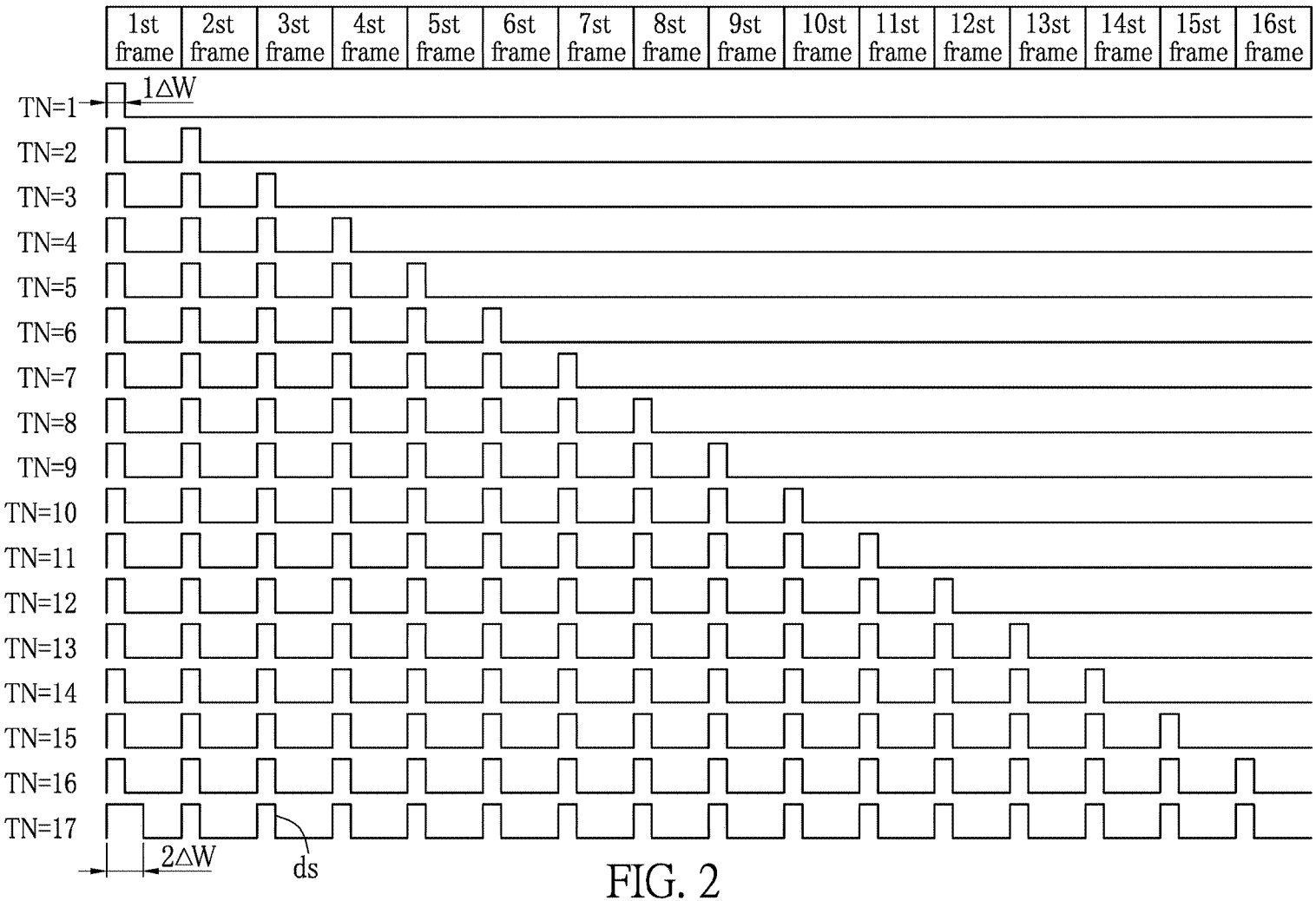
FIG. 2 is another schematic diagram of the dimming signal of a light emitting diode display device.

Reference will now be made in detail to the exemplary embodiments of the instant disclosure, examples of which are illustrated in the accompanying drawings. Wherever possible, the same reference numbers are used in the drawings and the description to refer to the same or like parts.

Figure 3:
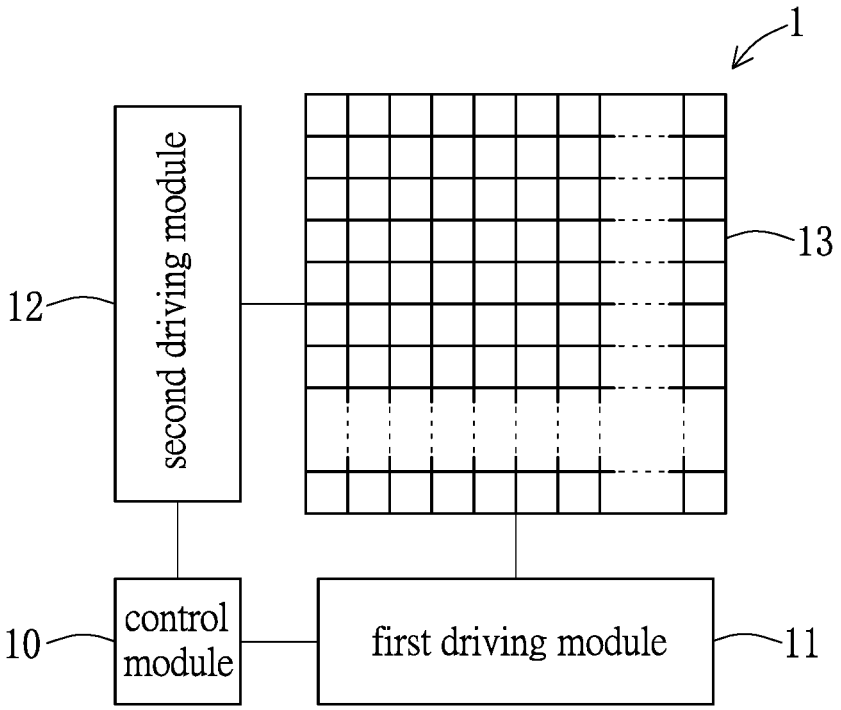
FIG. 3 is a schematic diagram of a light emitting diode display device according to an embodiment of the present disclosure.

Referring to FIG. 3, a light emitting diode display device 1 includes a control module 10, a first driving module 11, a second driving module 12 and a light emitting diode matrix module 13. The control module 10, the first driving module 11 and the second driving module 12 are light emitting diode driving circuits.

In the embodiment, the control module 10 is electrically connected to the first driving module 11 and the second driving module 12. The first driving module 11 and the second driving module 12 are electrically connected to the light emitting diode matrix module 13.

The light emitting diode matrix module 13 includes a plurality of light emitting diode units (not shown). The light emitting diode units are arranged in a matrix mode. The light emitting diode matrix module includes M×N light emitting diode units (not shown), namely, an M×N matrix. Each column of the light emitting diode matrix module 13 includes M light emitting diode units (not shown) and each row of the light emitting diode matrix module 13 includes N light emitting diode units (not shown).

The control module 10 provides a first driving signal to drive each column of the light emitting diode units of the light emitting diode matrix module 13 through the first driving module 11. The control module 10 provides a second driving signal to drive each row of the light emitting diode units of the light emitting diode matrix module 13 through the second driving module 12.

In the embodiment, the first driving signal of the first driving module 11 includes a voltage signal, a current signal and a pulse width modulation signal, but is not limited thereto.

Referring to FIG. 3, the light emitting diode matrix module 13 includes 8×16 light emitting diode units U. In other embodiments, the light emitting diode matrix module 13 can include more the light emitting diode units U. However, when the scale of the light emitting diode matrix module 13 is larger, the driving signals are attenuated at the last area of the transmission line. Therefore, the scale of the light emitting diode matrix module 13 is determined based on the driving capability of the first driving module 11 and the second driving module 12.

Figure 4:
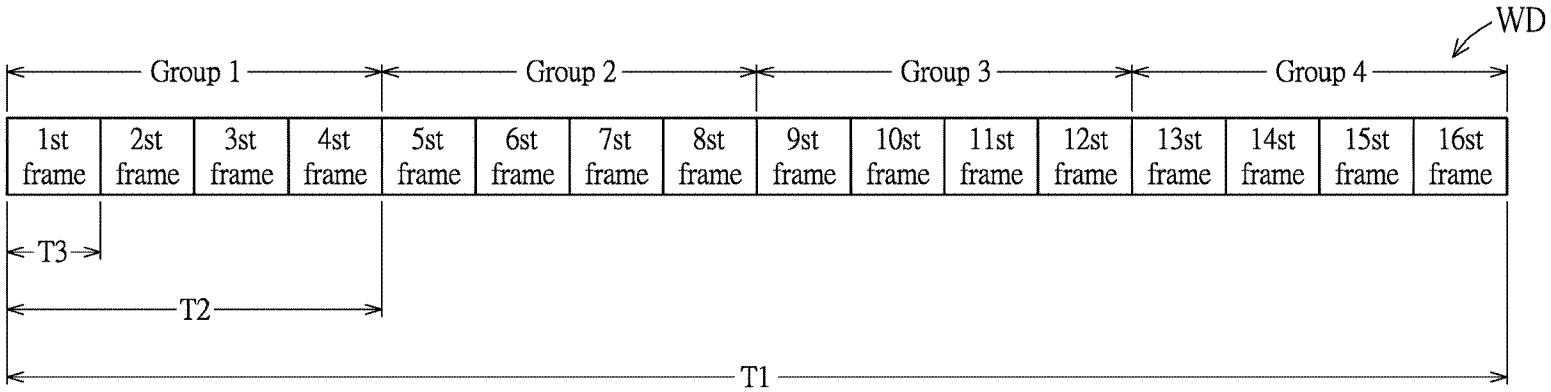
FIG. 4 is a schematic diagram of a working interval of a second driving signal according to an embodiment of the present disclosure.

Referring to FIG. 4, the control module 10 uses the second driving signal that is 60 Hz scanning frequency to drive the light emitting diode matrix module 13. The second driving signal includes a plurality of working intervals WD. Each working interval includes a first frame group Group1, a second frame group Group2, a third frame group Group3 and a forth frame group Group4.

In the embodiment, each frame group includes four frames. The first frame group Group1 includes a first frame, a second frame, a third frame and a fourth frame. The second frame group Group2 includes a fifth frame, a sixth frame, a seventh frame and an eighth frame. The third frame group Group3 includes a ninth frame, a tenth frame, an eleventh frame and a twelfth frame. The fourth frame group Group4 includes a thirteenth frame, a fourteenth frame, a fifteenth frame and a sixteenth frame. These frames are arranged sequentially.

Each working interval WD has a first time interval T1. Each frame group has a second time interval T2. Each frame has a third time interval T3. The first time interval T1 is four times of second time interval T2. The second time interval T2 is four times of the third time interval T3.

Figure 5:
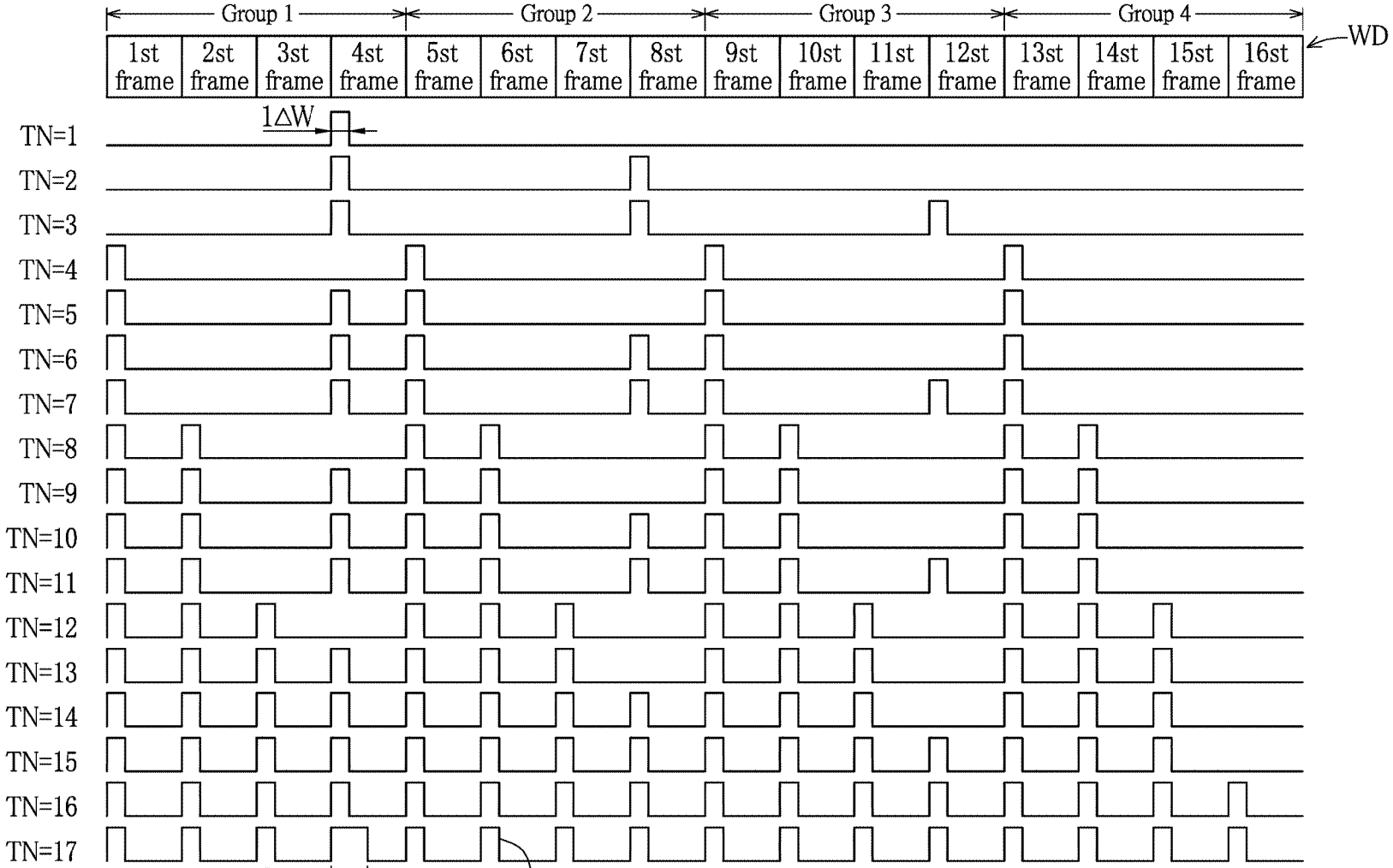
FIG. 5 is a schematic diagram illustrating the arrangement of the dimming signal of the present disclosure.
Figure 6:
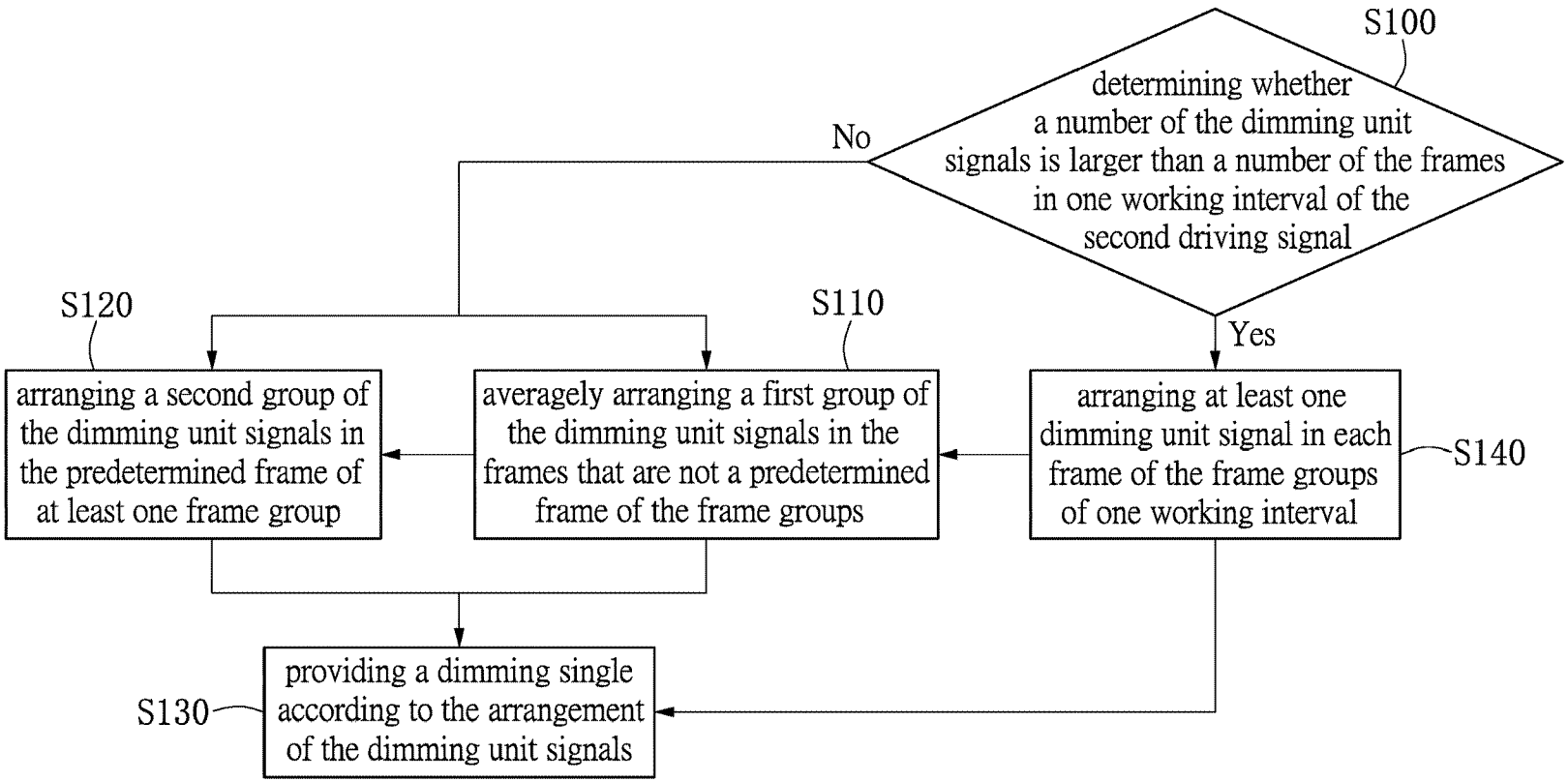
FIG. 6 is a flow chart of a dimming signal arranging method according to an embodiment of the present disclosure.

Referring to FIG. 5, an embodiment of arranging method for a dimming signal of the present disclosure is descripted as follows.

In the embodiment, the brightness of the light emitting diode matrix module 13 can be presented by a number of the dimming unit signals ds. When the number of the dimming unit signal is 1, the brightness of the light emitting diode matrix module 13 is 1 level. When the number of the dimming unit signal is 18, the brightness of the light emitting diode matrix module 13 is 18 levels. The levels of the brightness can be designed according to practical requirements, which is not limited in the present disclosure.

In the embodiment, the dimming unit signals are averagely arranged in different frame groups. When the number of the dimming unit signal is 2, one of the two dimming unit signals is arranged in the first frame group Group1, and the other dimming unit signal is arranged in the second frame group Group2. However, in the embodiment, the two dimming unit signals are not arranged in the first frame and the fifth frame, which are respectively arranged in the fourth frame and the eighth frame. In the embodiment, a time interval of each dimming unit signal ds is 1ΔW that is less than the third time interval T3.

In the embodiment, when the number of the dimming unit signals is 5, the four dimming unit signal of the five dimming unit signals ds are respectively arranged in the first frame of the first frame group Group1, the fifth frame of the second frame group Group2, the ninth frame of the third frame group Group3, and the thirteenth frame of the fourth frame group Group4. The fifth dimming unit signal ds is arranged in the fourth frame of the first frame group Group1. In other words, the five dimming unit signals are averagely arranged in each frame group for minimizing the flicker phenomenon of the light emitting diode unit (not shown).

In the embodiment, the number of the frame groups and the number of the frames of each frame group are variable based on practical requirements.

Referring to FIG. 5, in the embodiment, when the brightness is larger than 2, a time difference of the two adjacent dimming unit signals that are arranged in different frame groups is less than or equal to the second time interval T2 and larger than the third time interval T3.

The time difference between the two adjacent dimming unit signals that are arranged in the same frame group is larger than or equal to the third time interval T3 and less than or equal to the second time interval T2.

A dimming signal arranging method provided in the present disclosure includes the following steps: determining whether a number of the dimming unit signals is larger than a number of the frames in one working interval of the second driving signal (Step S100); averagely arranging a first group of the dimming unit signals in the frames that are not a predetermined frame of the frame groups (Step S110); arranging a second group of the dimming unit signals in the predetermined frame of at least one frame group (Step S120); and providing a dimming single according to the arrangement of the dimming unit signals (Step S130).

In the embodiment, after Step S100, the arranging method for the dimming signals further includes the step: arranging at least one dimming unit signal in each frame of the frame groups of one working interval (Step S140).

In the embodiment, the control module 10 drives the light emitting diode matrix module 13 through the second driving signal. The second driving signal is 60 Hz scanning frequency. The second driving signal includes a plurality of working intervals WD. Each working includes four frame groups. Each frame group includes four frames. In other embodiments, the number of the frame groups and the number of the frames of each frame group are variable based on practical requirements.

In the embodiment, each frame group includes four frames. The first frame group Group1 includes a first frame, a second frame, a third frame and a fourth frame. The second frame group Group2 includes a fifth frame, a sixth frame, a seventh frame and an eighth frame. The third frame group Group3 includes a ninth frame, a tenth frame, an eleventh frame and a twelfth frame. The fourth frame group Group4 includes a thirteenth frame, a fourteenth frame, a fifteenth frame and a sixteenth frame. These frames are arranged sequentially.

In Step S100, the number of the dimming unit signal TN is determined whether it is larger than the total number of the frames M in one working interval WD of the second driving signal. In the embodiment, the number of the dimming unit signal TN (brightness level) can be larger than the total number of the frames M of each working interval WD.

When the total number of the dimming unit signal TN is less than the total number of the frame M in one working interval WD, Step S100 is executed. However, when the total number of the dimming unit signal TN is less than the number of the frame groups in one working interval WD, Step S120 is executed. When the total number of the dimming unit signal TN is larger than the total number of the frames M in one working interval WD, Step S140 is executed.

In Step S110, the first group of the dimming unit signals is averagely arranged in the frames of the frame groups that are not the predetermined frame.

In the embodiment, the dimming unit signals can be divided into two parts. The number of first part is N1 and the number of the second part is N2. The number N1 of the first part is a multiple of the number of the frame groups in one working interval WD. Therefore, the number N1 of the first part includes 4, 8, or 12. In other words, the number N1 is obtained by a result that a quotient of the total number of the dimming signals TN divided by the number of the frame groups in one working interval WD multiples the number of frames in one frame group. In Step S110, the first part of the dimming unit signals is averagely arranged in the frame groups. In the embodiment, the first part of the dimming unit signals is arranged in the at least one frame of the frame groups that are not the fourth frame, the eighth frame, the twelfth frame and the sixteenth frame. In other words, the predetermined frame in the embodiment is the fourth frame, the eighth frame, the twelfth frame and the sixteenth frame. In other embodiments, the predetermined frame can be the first frame or the second frame, which is not limited thereto.

When the number of the first part of the dimming unit signals is 4, the four dimming unit signals are arranged in the first frame of the first frame group Group1, the fifth frame of the second frame group Group2, the ninth frame of the third frame group Group3 and the thirteenth frame of the fourth frame group Group4. When the number of the first part of the dimming unit signals is 8, the eight dimming unit signals are arranged in the first frame, the second frame, the fifth frame, the sixth frame, the ninth frame, the tenth frame, the thirteenth frame, and the fourteenth frame.

In the embodiment, the starting frame for the arrangement of dimming unit signals is the first frame of each frame group. In other embodiments, the starting frame can be selected based on practical requirements.

In the Step S120, the second part of the dimming unit signals N2 is arranged in the predetermined frame of the at least one frame group. In the embodiment, the predetermined frame is the last frame of each frame group. In addition, the arrangement of the predetermined frames is the fourth frame, the eighth frame, the twelfth frame, and the sixteenth frame.

In the embodiment, when the total number of the dimming unit signals is one, two or three, the dimming unit signals are not averagely arranged in each frame group. Therefore, when the total number of the dimming unit signal TN is less than the number of the frame groups of each working interval WD, Step S120 is executed.

In Step S140, when the total number of the dimming unit signals TN is larger than the total number M of the frames in one working interval WD, one dimming unit signal is arranged in each frame of the working interval WD, and the other dimming unit signals are arranged according to Step S110, Step S120 and Step S130. As shown in FIG. 5, when the number of the dimming unit signal is 17, two dimming unit signals ds are arranged in the third frame. The time interval of the dimming unit signals in the third frame is 2ΔW.

According to the above, a plurality of frames of one working interval of the dimming signal are grouped into a plurality of frame groups, and the dimming unit signals for adjusting the brightness are averagely arranged in the frames as much as possible. Therefore, the brightness of the light emitting diode display device becomes more uniform, and the flicker phenomenon can be minimized at the low level brightness.

The above-mentioned descriptions represent merely the exemplary embodiments of the instant disclosure, without any intention to limit the scope of the instant disclosure thereto. Various equivalent changes, alterations or modifications based on the claims of present disclosure are all consequently viewed as being embraced by the scope of the instant disclosure.

What is claimed is:

1. A light emitting diode display device, comprising:

a light emitting diode matrix module;

a control module;

a first driving module, electrically connected to the control module and the light emitting diode matrix module; and a second driving module, electrically connected to the control module and the light emitting diode matrix module;

wherein the control module provides a first driving signal to drive the light emitting diode module through the first driving module, the control module provides a second driving signal to drive the light emitting diode module through the second driving module, wherein the control module adjusts brightness of the light emitting diode matrix module;

wherein the second driving signal includes a predetermined number of dimming unit signals;

wherein the second driving signal includes a plurality of working intervals, each working interval has a first time interval;

wherein each working interval of the second driving signal includes a plurality of frame groups, each frame group includes a plurality of frames, each frame group has a second time interval, each frame has a third time interval;

wherein when a number of the dimming unit signals is greater than 2, time interval between the two adjacent dimming unit signals that are arranged in different frame groups is less than or equal to the second time interval and greater than the third time interval.

2. The light emitting diode display device of claim 1, wherein when the number of the dimming unit signals is greater than 2, time interval between the two adjacent dimming unit signals that are arranged in the same frame groups is greater than or equal to the third time interval and less than the second time interval.

3. The light emitting diode display device of claim 1, wherein when the number of the dimming unit signals is less than a number of the frame groups of one working interval of the second driving signal, the dimming unit signals are arranged in at least one predetermined frame of the frame groups of the working interval of the second driving signal.

4. The light emitting diode display device of claim 1, wherein when the number of the dimming unit signals is greater than a number of the frame groups of one working interval of the second driving signal, a first group of the dimming unit signals of the dimming unit signals is averagely arranged in at least one frame of each frame group that is not a predetermined frame, a number of the first group of the dimming unit signals is a multiple of a number of the frame groups.

5. The light emitting diode display device of claim 4, wherein a second group of the dimming unit signals is arranged in the predetermined frame of at least one frame group.

6. The light emitting diode display device of claim 1, wherein when the number of the dimming unit signals is greater than the number of the frames of the working interval of the second driving signal, a part of the dimming unit signals is arranged in each frame of the working interval, a number of the part of the dimming unit signals is a multiple of the number of the frames of each working interval.

7. The light emitting diode display device of claim 6, wherein when a difference of the total number of the dimming unit signals and a number of the part of the dimming unit signals is greater than the number of the frame groups of the working interval and less than the number of the frames of the working interval, a first group of the difference between the total number of the dimming unit signals and the number of the part of the dimming unit signals is averagely arranged in at least one frame of each frame group that is not a predetermined frame, and a number of the first group of the dimming unit signals is a multiple of a number of the frame groups.

8. The light emitting diode display device of claim 7, wherein a second group of the dimming unit signals is arranged in the predetermined frame of the frame groups.

* * * * *